United States Patent [19]

Proksch

[11] 4,076,099

[45] Feb. 28, 1978

[54] DEVICE FOR REDUCING ENGINE EXHAUST NOISE

[75] Inventor: Frederick D. Proksch, Peoria, Ill.

[73] Assignee: Caterpillar Tractor Co., Peoria, Ill.

[21] Appl. No.: 674,030

[22] Filed: Apr. 5, 1976

[51] Int. Cl.[2] ..... F01N 1/08; F01N 1/00

[52] U.S. Cl. ..... 181/264; 181/268; 181/281

[58] Field of Search ..... 181/70, 63, 49, 57, 181/264, 268, 281

[56] References Cited

U.S. PATENT DOCUMENTS

| | | | |
|---|---|---|---|
| 1,170,807 | 2/1916 | Egan | 181/70 |
| 1,412,416 | 4/1922 | O'Connor | 181/57 |
| 1,866,004 | 7/1932 | Beamer | 181/70 |
| 2,458,102 | 1/1949 | Schott et al. | 181/57 |
| 2,523,260 | 9/1950 | Campbell | 181/63 |
| 3,196,977 | 7/1965 | Sanders | 181/70 |
| 3,884,323 | 5/1975 | Kunz, Jr. | 181/70 |

*Primary Examiner*—Stephen J. Tomsky
*Attorney, Agent, or Firm*—Phillips, Moore, Weissenberger, Lempio & Majestic

[57] ABSTRACT

An attenuator for reducing exhaust noise in engines is provided which includes an exhaust pipe having a flared outlet and a frustoconically shaped attenuator member mounted therein. In an alternate embodiment, vents are provided to increase efficiency. In a further alternate embodiment, the exhaust pipe is combined with a muffler.

2 Claims, 8 Drawing Figures

DEVICE FOR REDUCING ENGINE EXHAUST NOISE

BACKGROUND OF THE INVENTION

This invention relates to devices for attenuating exhaust noise. More particularly, this invention relates to an attenuator member mounted within an exhaust pipe for changing exhaust fluid direction and reducing exhaust noise.

Engines such as internal combustion and gas turbine engines produce large quantities of exhaust gases which must be vented to atmosphere. These exhaust gases exit through exhaust pipes at high velocities and produce sound and noise at very high decibel (db) levels. These high noise levels can be injurious to the hearing of operators in the vicinity of the engines producing the noise.

With the advent of federal Occupational Health and Safety (OSHA) standards it has become mandatory to reduce noise levels to acceptable limits within the OSHA guidelines. Typically, current engine exhaust pipes direct exhaust gases straight out the pipe end or outlet. Exhaust gas velocity and temperature gradients just beyond the end of the exhaust pipe create velocity and sound distribution in the exhaust gases which causes sound to be diffracted radially outwardly of the pipe axis. Observers or operators laterally opposite the exhaust pipe are thus presented with high noise levels.

SUMMARY AND OBJECTS OF THE INVENTION

The present invention includes an attenuator member or diffuser mounted within a flared exhaust pipe for directing sound toward the exhaust pipe axis and thus preventing it from moving radially outwardly where it can cause problems to laterally positioned operators. The attenuator member is mounted within an exhaust pipe having smaller diameter and a larger diameter end joined by an intermediate frustoconically shaped transition portion. The attenuator member is correspondingly frustoconically shaped and spaced from the frustoconically shaped transition portion.

The attenuator member is mounted to the exhaust pipe by a centrally disposed elongated rod attached thereto at one end and to a bracket formed by three plates having their planar surfaces within the exhaust gas stream and parallel to the exhaust pipe axis. In this manner exhaust gas flow is only minimally impeded.

The attenuator member thus described causes the exhaust gases passing therearound to diffuse and eddy so that noise is directed toward the exhaust pipe axis rather than radially away as with unattenuated exhaust pipes.

In an alternate embodiment of the invention, vents are added to the attenuator member to increase efficiency.

In a further alternate embodiment the exhaust pipe is combined with a muffler for additional sound control. The muffler forms a chamber around the exhaust pipe and a plurality of perforations in the pipe give access to the chamber from the pipe interior.

It is therefore the primary object of this invention to provide a means for reducing exhaust noise.

It is a further object to provide attenuation of exhaust pipe gas velocity.

It is a further object of this invention to provide an attenuator for an exhaust pipe for directing noise radially inwardly toward the pipe axis.

Further and other objects will become more readily apparent from a review of the following specification and accompanying drawings.

DETAILED DESCRIPTION

Figure 1:
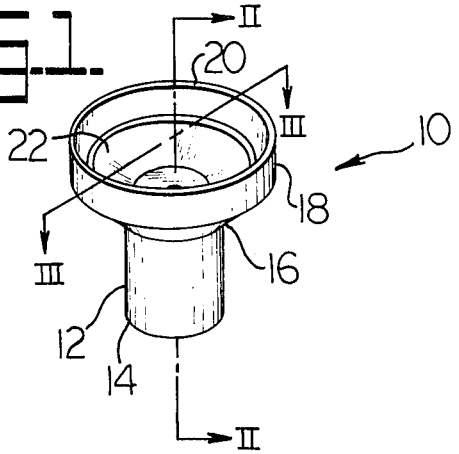
FIG. 1 is an overall isometric view of the exhaust noise reducing device of the instant invention.

Turning to FIG. 1, there is shown generally at 10 an exhaust pipe comprising a tubular inlet portion 12 having an open inlet 14 for admitting exhaust gas from, e.g., an internal combustion engine. The exhaust pipe has a frustoconical transition portion 16 leading to an outlet or exhaust portion 18 having an open outlet 20.

Figure 2:
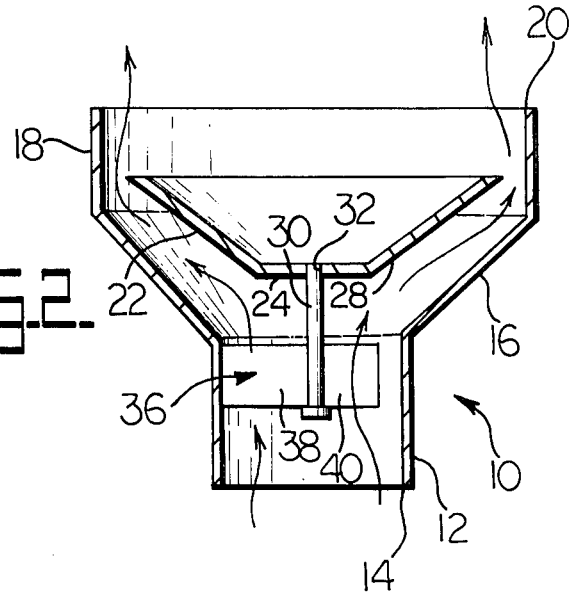
FIG. 2 is a front elevational cross-section view of the same taken along lines II—II in FIG. 1.
Figure 3:
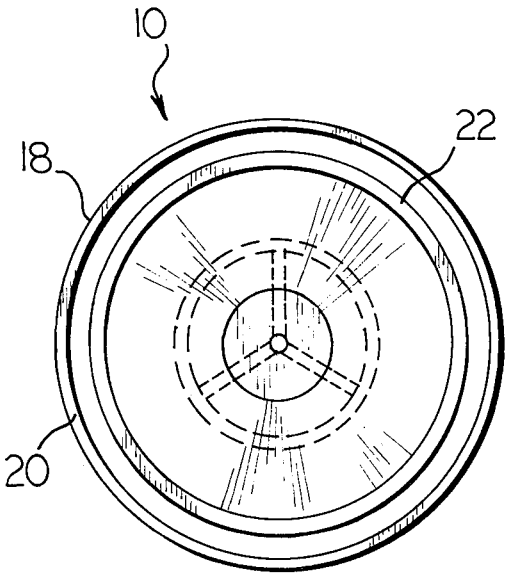
FIG. 3 is a top plan view of the same taken along lines III—III in FIG. 1.

Within the flared outlet portion is an attenuator member or baffle 22. As best seen in FIGS. 2 and 3, attenuator member or baffle 22 has a circular forward or inlet end wall 24 and a frustoconically shaped side wall 28 joined to the inlet wall. Mounting means are provided in the form of an elongated rod 30 fitted in aperture 32 in inlet wall 24. An opposite end of rod 30 is fixed to a bracket 36 formed by three planar plate members, two of which are shown at 38,40. The plane of the plate members is set to be parallel to the axis defined by inlet portion 12 and thereby the exhaust gases carried therein so as to minimally impede flow thereof. The bracket 36 and the attenuator member 22 may be fixed to rod 30 by any convenient means, such as welding.

Figure 4:
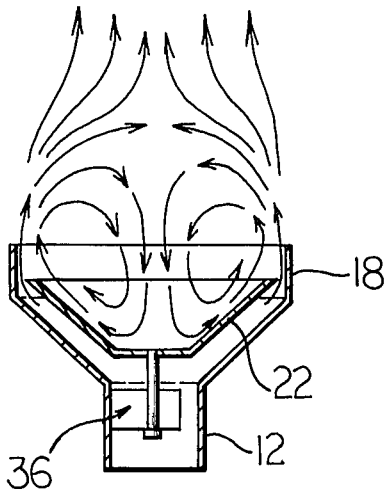
FIG. 4 is a view of the same similar to FIG. 2, and showing flow geometry.

The baffle is mounted so that its side wall 28 is in spaced, parallel relation with respect to transition portion 16. In this manner, exhaust gases are desirably directed around the baffle and through outlet 20. The flow geometry of this baffle is illustrated in FIG. 4.

Figure 5:
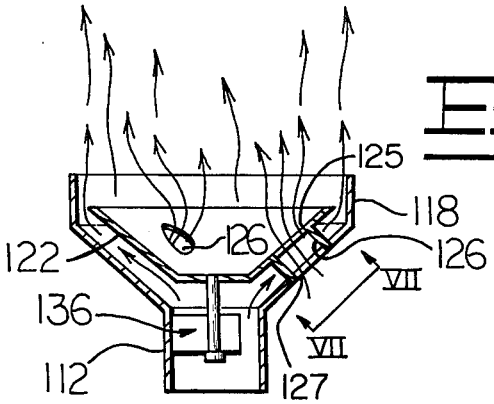
FIG. 5 is a view similar to FIG. 4 of an alternate embodiment having vents and illustrating a different flow geometry.
Figure 7:
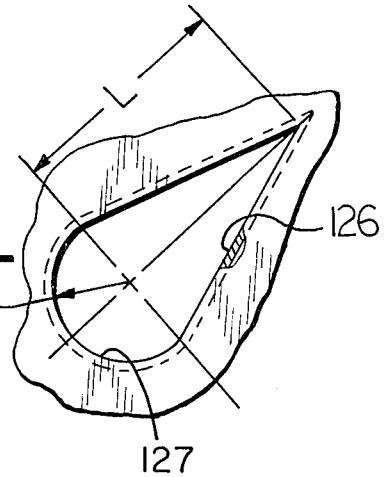
FIG. 7 is a view taken along lines VII—VII in FIG. 5 and illustrating the shape of a single vent; and, FIG. 8 is a front elevational cross-section view of an alternate embodiment in combination with a muffler.
Figure 6:
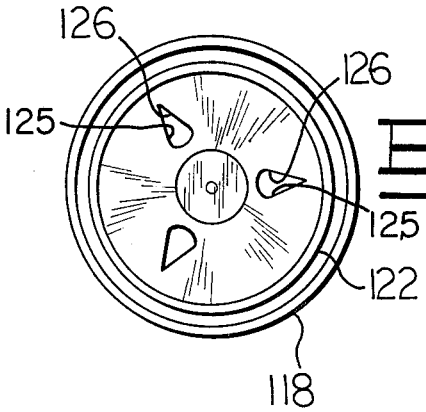
FIG. 6 is a top plan view of the embodiment of FIG. 5.

As a further refinement, an alternate embodiment is shown in FIGS. 5–7, having three equally spaced generally elongated, hollow vents defining walls 126 for admitting air flow from the ambient surrounds to be mixed with the exhaust gases. Walls 126 partially support the baffle and are interconnected between a pair of openings 125, 127 in the baffle and transition portion, respectively. In actual comparative tests between the FIGS. 1–4 and FIGS. 5–7 embodiments using an engine operation at 2200 RPM, at 160 BMEP, vacuum, a measure of performance, was measured at the muffler inlet. With vents of the shape shown in FIG. 7 having a semicircular lead portion of radius R and an elongated tail portion of length L having a cross-sectional area equal to the cross-sectional area of the main tubular inlet portion 112, the vacuum was approximately 4.55 in. Hg. as opposed to approximately 3 in. Hg. with 1200 CFM flow. Diffuser efficiency was approximately 43 percent with vents as opposed to approximately 55 percent without. Another difference was that the annular jet coalesced close to the muffler exit without vents (FIG. 4), but did not with vents (FIG. 5). This is considered to be advantageous from an acoustic standpoint. Velocity head measurements in the vents indicated that at 1200 CFM primary exhaust flow, the aspirated ventilation flow was about 20 percent of this value.

Figure 8:
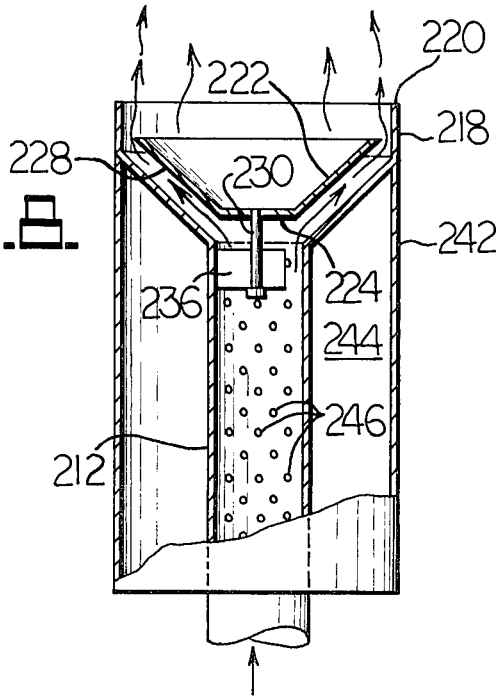

FIG. 8 shows a further alternate embodiment. With this embodiment a tubular muffler body 242 defining an annular muffler chamber 244 around inlet portion 212 is provided. A plurality of perforations or holes 246 is contained in inlet portion 212 which allows intercommunication between the interior of exhaust pipe portion 212 and chamber 244.

It is to be understood that the foregoing description is merely illustrative of a preferred embodiment of the invention, and that the scope of the invention is not to be limited thereto but is to be determined by the scope of the appended claims.

What is claimed is:

1. A device for reducing exhaust noise comprising: an exhaust pipe having inlet and outlet portions separated by an intermediate transition portion, said inlet and outlet portions being generally tubular and defining inlet and outlet diameters, said outlet diameter being greater than said inlet diameter, and further including baffle means at least partially within said transition portion for reducing exhaust noise, said transition portion being generally frustoconical in shape and wherein said baffle means comprises a correspondingly frustoconically shaped baffle, and mounting means mounting said baffle within said exhaust pipe, and spaced from said generally frustoconical transition portion whereby exhaust fluid passing through said inlet portion and out said outlet portion by way of said transition portion is deflected generally radially outwardly by said baffle, said baffle defining a generally circular forward end wall joined to a frustoconically shaped baffle side wall, said frustoconically shaped baffle side wall being in spaced parallel relation to said frustoconically shaped transition portion, and further including vent means in said frustoconical transition portion and said baffle sidewall fluidly intercommunicating the exterior thereof with the interior of said baffle, said vent means comprising openings in said baffle sidewall and said transition portion, and generally elongated, hollow vents defining walls at least partially supporting said baffle and shaped so as to have a semi-circular lead portion and an elongated tail portion along opposite sides thereof, said lead portion being oriented toward said inlet and said tail portion being oriented toward said outlet so as to facilitate exhaust flow therearound, and wherein said hollow vents are of integral, one-piece construction with said frustoconical transition portion and said frustoconically shaped baffle so as to produce a unitary device.

2. A device for reducing exhaust noise comprising: an exhaust pipe having inlet and outlet portions separated by an intermediate transition portion, said inlet and outlet portions being generally tubular and defining inlet and outlet diameters, said outlet diameter being greater than said inlet diameter, a frustoconically shaped baffle defining a circular, forward end wall, at least partially within and spaced from said transition portion for reducing exhaust noise, a mounting rod member defining a pair of opposite ends, one end of said mounting rod member being fixed to said forward end wall, a mounting bracket fixing the other end of said rod to said exhaust pipe, means defining a muffler chamber around said exhaust pipe and means defining a plurality of perforations in said exhaust pipe for intercommunicating the interior of said exhaust pipe with said chamber, and wherein said means defining a muffler chamber comprises a generally tubular body surrounding said exhaust pipe of a diameter equal to said outlet diameter.

* * * * *